US006823887B2

(12) United States Patent
Dulac

(10) Patent No.: US 6,823,887 B2
(45) Date of Patent: Nov. 30, 2004

(54) WATER HEATER SHUT OFF DEVICE WITH WATER PRESSURE DELAY LINE

(76) Inventor: Lawrence M. Dulac, 173 Portsmouth Ave., Manchester, NH (US) 03109

( * ) Notice: Subject to any disclaimer, the term of this patent is extended or adjusted under 35 U.S.C. 154(b) by 225 days.

(21) Appl. No.: 10/071,432

(22) Filed: Feb. 8, 2002

(65) Prior Publication Data

US 2002/0104564 A1 Aug. 8, 2002

Related U.S. Application Data

(60) Provisional application No. 60/267,273, filed on Feb. 8, 2001.

(51) Int. Cl.[7] ..... F16K 17/00

(52) U.S. Cl. ..... 137/334; 137/341; 137/487; 251/50; 251/54

(58) Field of Search ..... 137/334, 341, 137/487; 251/50, 54

(56) References Cited

U.S. PATENT DOCUMENTS

| | | | | |
|---|---|---|---|---|
| 2,868,492 A | | 1/1959 | Volcov et al. | |
| 2,921,597 A | | 1/1960 | Parr | |
| 3,078,066 A | | 2/1963 | Moore | 251/331 |
| 3,754,563 A | * | 8/1973 | Boals | 137/94 |
| 3,768,497 A | | 10/1973 | Mueller | 137/38 |
| 4,000,754 A | | 1/1977 | Risk | 137/487 |
| 4,305,420 A | | 12/1981 | Nussdorf | 137/312 |
| 4,691,726 A | | 9/1987 | Studer et al. | 137/15 |
| 4,909,274 A | | 3/1990 | Rodriguez | 137/312 |
| 5,007,364 A | | 4/1991 | Buckle | 114/331 |
| 5,024,254 A | | 6/1991 | Yamagiwa | 137/219 |
| 5,060,630 A | | 10/1991 | Boals | 126/362 |
| 5,117,863 A | | 6/1992 | McGarrah | 137/559 |
| 5,143,258 A | | 9/1992 | Mittermaier | 137/599 |
| 5,169,291 A | | 12/1992 | Zebuhr | 417/41 |
| 5,240,022 A | | 8/1993 | Franklin | 137/1 |
| 5,301,919 A | | 4/1994 | May | 251/30.02 |
| 5,421,365 A | | 6/1995 | Matsuo et al. | 137/599 |
| 5,425,396 A | | 6/1995 | Wodeslavsky | 137/488 |
| 5,439,028 A | | 8/1995 | Meyer et al. | 137/556 |
| 5,738,333 A | | 4/1998 | Cognevich et al. | 137/489.5 |
| 6,021,808 A | * | 2/2000 | Dulac | 137/487 |

FOREIGN PATENT DOCUMENTS

| | | | |
|---|---|---|---|
| GB | 1417399 | 12/1975 | 31/11 |

* cited by examiner

*Primary Examiner*—A. Michael Chambers
(74) *Attorney, Agent, or Firm*—Bourque & Associates

(57) ABSTRACT

A water supply shut off system includes a water pressure delay device which delays the transmission of any apparent change in water pressure between the input and the output side of the valve to the control input of the valve. This delay allows the input and output pressures to have a chance to generally equalize without falsely tripping the device. The water supply shut off system can also include a thermal expansion/contraction device that allows thermal expansion and contraction of a fluid medium, such as water, when the shut off device is used with a device to be protected such as a hot water heater.

18 Claims, 3 Drawing Sheets

WATER HEATER SHUT OFF DEVICE WITH WATER PRESSURE DELAY LINE

CROSS-REFERENCE TO RELATED APPLICATIONS

The present application claims the benefit of U.S. Provisional Application Ser. No. 60/267,273 filed Feb. 8, 2001, which is fully incorporated herein by reference.

TECHNICAL FIELD

The present invention relates to devices, such as valves, which shut off a supply of water or other fluid in the case of an unwanted leak or the like.

BACKGROUND INFORMATION

There are several known devices that attempt to shut off the flow of water to a device that may potentially leak, such as a hot water heater. The purpose of these devices is to ensure that the supply of water is provided to such devices only in the case of a legitimate demand from the user. These devices also prevent or stop the flow of water in the event of a leak, so that there will be no new water introduced into the system to feed the leaking device.

An example of such a device is applicant's own device disclosed in U.S. Pat. No. 6,021,808, which is fully incorporated herein by reference. Experimentation with such devices, however, has led to the discovery that there may be one or more instances when an unintentional "tripping" of the valve can occur even though there is not a true "fault" condition. Such a situation is often termed a "nuisance call" in the industry.

One manner in which such an unwanted fault can occur is when there is a significant pressure difference between the input and the output side of the valve. This can occur due to many reasons. For example, it may occur due to the fact that the output of the device, that is the side on the hot water tank, was filled during a time when the inlet water pressure was substantially lower. If the inlet water pressure rises some 10, 20 or more pounds above the output pressure, this can trick the valve into believing that there is a fault condition, thereby maintaining the valve closed, until reset manually.

A similar condition can occur in homes or businesses using private water supplies from wells or pumps. It is well known that water systems with wells or pump water experience significant fluctuations in water pressure. These fluctuations are due to the fact that the water pressure must drop low enough to trigger the pump to run long enough to fully pressurize or charge the water system. In either case, with several of the presently designed valves, the difference in the water pressure reaches the valve control line faster then the water pressure can equalize between the input and the output sides of the valve, causing a false triggering or tripping of the valve.

Accordingly, what is needed is a system, including one or more elements that can delay or slow down the system or drawn down water pressure from reaching the control line of such devices. This delay allows the water pressures to equalize between the input and output side of the valve, essentially eliminating false trigger conditions.

An additional concern with such devices is the thermal expansion and contraction, which occurs as a device to be protected, such as a water heater, heats water and shuts off. As is well known, heated water expands, while water contracts as it cools. Without a mechanism to control or account for the expansion and contraction of water, a device meant to prevent excess water leakage due to an unwanted event such as a leak will not work consistently well. Accordingly, another aspect of the present invention is to provide for and allow thermal expansion and contraction of water when used with a heating device such as hot water heater.

SUMMARY

In accordance with one aspect of the present invention, a fluid supply shut off valve system is used with a device to be protected. The system comprises a fluid monitoring device including a shut off valve, a main input, a main output, and a pressure sensor line. The shut off valve is in a normally closed position and opens to supply fluid from the main input to the main output in response to a drop in pressure sensed by the pressure sensor line on an output side of the device to be protected. The fluid monitoring device monitors a pressure differential between the main input and the main output and causes the shut off valve to remain closed when the pressure differential reaches a predetermined amount. The system also includes a delay device coupled to the pressure sensor line. The delay device delays the response to an increase in pressure at the output side of the device to be protected.

In accordance with another aspect of the present invention, the fluid supply shut off valve system comprises the fluid monitoring device and a thermal expansion/contraction device coupled between the pressure sensor line and the output side of the device to be protected. The thermal expansion/contraction device allows contracting fluid to be drawn back into the device to be protected.

According to a further aspect of the present invention, the fluid supply shut off valve system comprises the fluid monitoring device, the delay device and the thermal expansion/contraction device.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
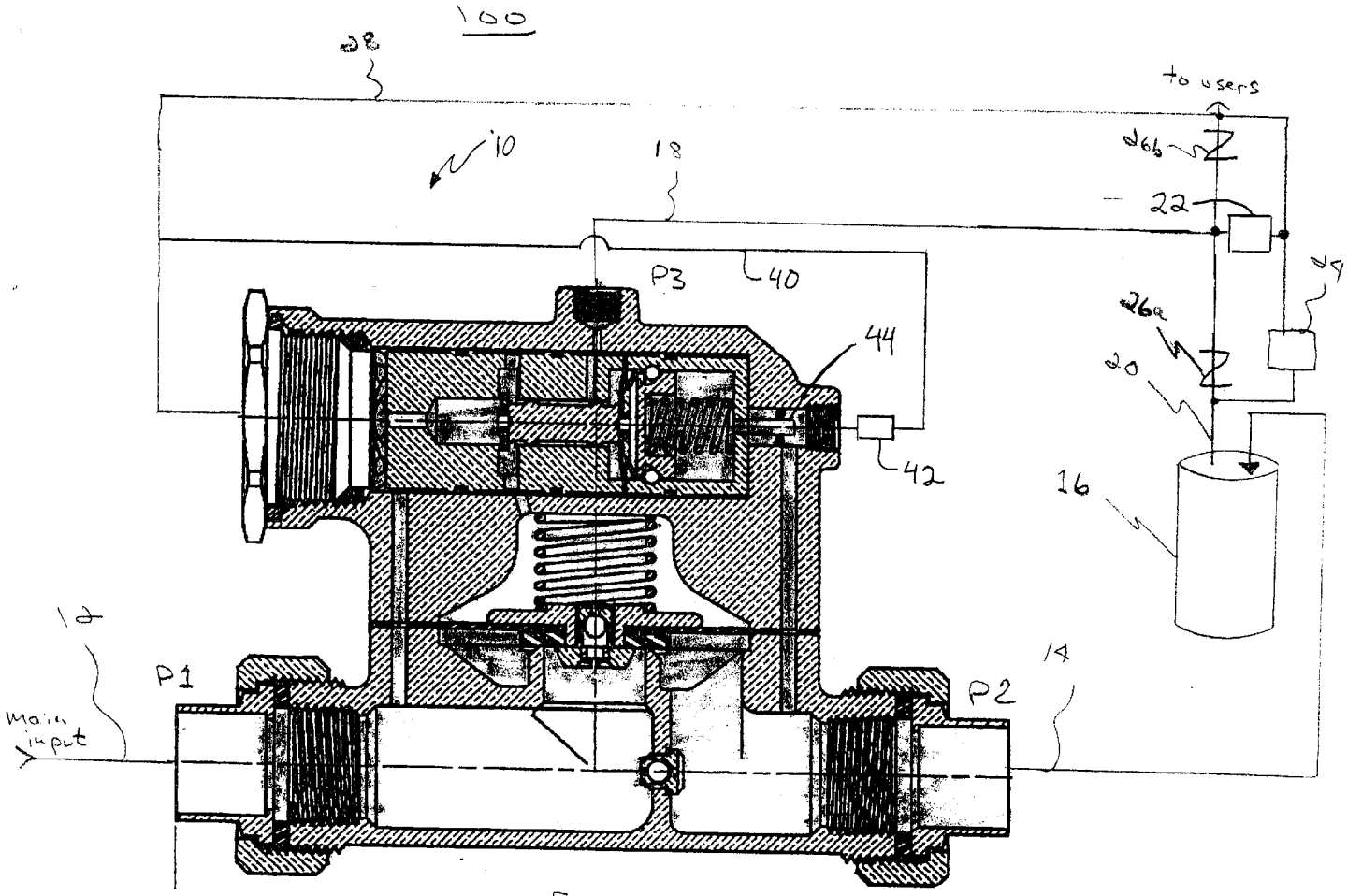
FIG. 1 is a schematic diagram of a valve incorporating the delay and expansion lines, according to one embodiment of the present invention.

In accordance with the teachings of the present invention, a fluid supply shut off valve system 100, FIG. 1, is shown. The system 100 incorporates a supply pressure sensor line delay and a device allowing for the thermal expansion and contraction of water when used with a fluid monitoring device 10. The fluid monitoring device 10 includes a main input or supply of water 12 and a main output 14 that flows to a device to be protected 16 such as a hot water heater. Although a hot water heater is utilized for exemplary purposes only, this is not a limitation of the present invention.

The fluid monitoring device 10 includes a supply pressure sensor line 18, which senses the fluid or water pressure on the supply or output side 20 of the device 16 to be protected.

One feature of the present invention is the incorporation of a water pressure delay device 22 in series with the supply pressure sensor line 18 and the output side 20 of the device to be protected 16. The provision of the delay device 22 allows any pressure difference between the main input 12 (PI) and the main output 14 (P2) to more closely equalize before the fluid pressure on the output side 20 of the device 16 is measured at point P3 on the fluid monitoring device 10 as supplied by the supply pressure sensor line 18.

The delay device 22 can be implemented in any number of fashions. The function of the delay device 22 is to delay any instantaneous change in pressure on the supply or output side 20 of the device being to be protected 16 from reaching the supply pressure sensor line 18 at point P3 on the fluid monitoring device 10. The delay device 22 can include one or more of the following: air bladders; water bladders; and "drippers" which may include pressure and non-pressure compensating devices which provide a reduced constant or non-constant flow of water or other fluid and act as a labyrinth which causes the water or other fluid medium to travel through a maze or series of channels within the drippers. Such drippers or labyrinths may be used alone or in combination with other devices including an air bladder or water bladder to help effectuate the delay. In addition, other items may be utilized to achieve the same purpose.

It should also be understood that the delay device(s) may be provided as separate elements that is, separate and apart from a fluid monitoring device 10. Alternatively, one or more of the delay devices may be incorporated into and formed as an integral part of the fluid monitoring device 10.

An additional feature of the present invention is a thermal expansion/contraction device 24, which, in one embodiment, may be provided on the supply or output side 20 of the device to be protected 16. Normally, the supply side 20 of the device to be protected includes one or more check valves 26 which prevents contracting water from being drawn back into the device to be protected 20. By providing the thermal expansion/contraction device 24, contracting water may be drawn back into the device to be protected 16 through the supply side 20, as will be explained in greater detail below in connection with FIG. 2.

Alternatively, a thermal expansion/contraction device 42 can be coupled to the fluid monitoring device 10. The thermal expansion/contraction device 42 is provided in a thermal expansion route or line 40, which is coupled to a supply line 28. The thermal expansion takes place up through the main output 14, the thermal expansion/contraction device 42, and the thermal expansion line 40. One embodiment of the thermal expansion/contraction device 42 is a labyrinth. In this embodiment, a thermal expansion shut off mechanism 44 is coupled to the shut off mechanism in the fluid monitoring device 10. When the fluid monitoring device 10 closes, the shut off mechanism 44 shuts off to prevent water from the thermal expansion/contraction device 42 from trickling back into the device to be protected 16. This shut off mechanism 44 works similar to and in conjunction with the shut off mechanism used in the fluid monitoring device 10.

Figure 2:
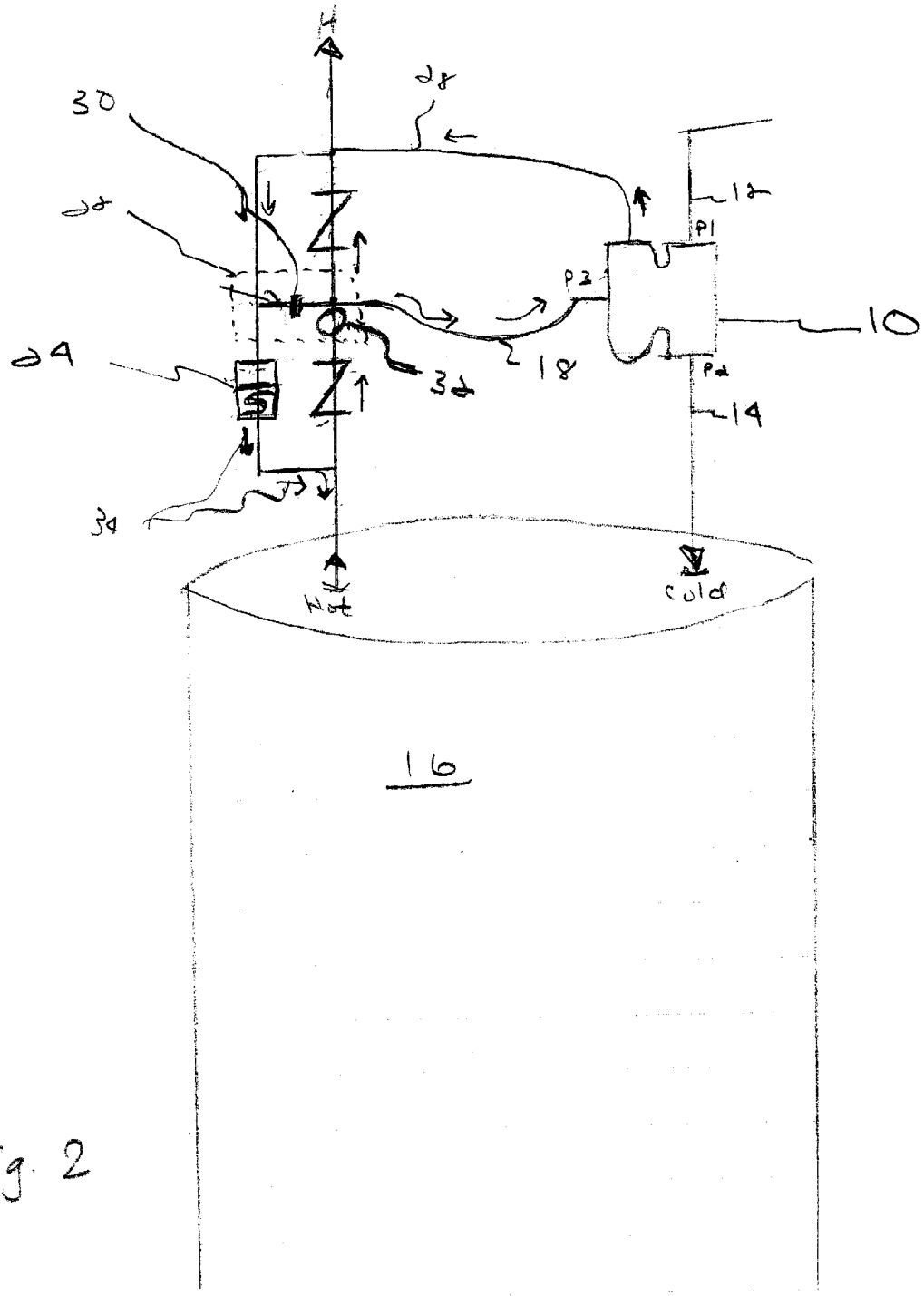
FIGS. 2 and 3 are schematic diagrams of a hot water system incorporating the valve, thermal expansion/contraction device and pressure delay device, according to one embodiment of the present invention.

FIG. 2 shows one embodiment and implementation of the supply pressure sensor line delay device 22 and the thermal expansion/contraction device 24 according to one embodiment of the present invention. As is shown, the device to be protected 16 is shown as a hot water tank, for exemplary purposes only. The fluid monitoring device 10 is installed in the cold water supply line 12/14 to the device to be protected 16.

As shown, the delay device 22 comprises of one or more devices such as a labyrinth or dripper 30 and a water hammer or other similar device 32, such as the type manufactured by Zilmet or Amtrol. A supply line 28 taken from the fluid monitoring device 10 is provided for several reasons. The first reason is to ensure that the pressure of P1 from the main input 12 can be provided to the control input P3 of the fluid monitoring device 10 through the delay device 22. It also allows for thermal contraction of heated water. Lastly, it allows for leaking faucets and compensates for any pressure lost through leaking faucets to be sure that the monitoring device 10 will still operate properly.

As previously mentioned, another feature of the present invention is the provision of the thermal expansion/contraction device 24 to compensate for thermal contraction. In the preferred embodiment, the thermal expansion/contraction device 24 includes a water expansion tank, which allows heated water to expand into the device 24. The expansion/contraction device 24 can also be a labyrinth. Once the water cools, the thermal expansion/contraction device 24 allows the same water to flow back as shown by arrows 34 into the device to be protected 16, e.g., the hot water tank or other device.

Figure 3:
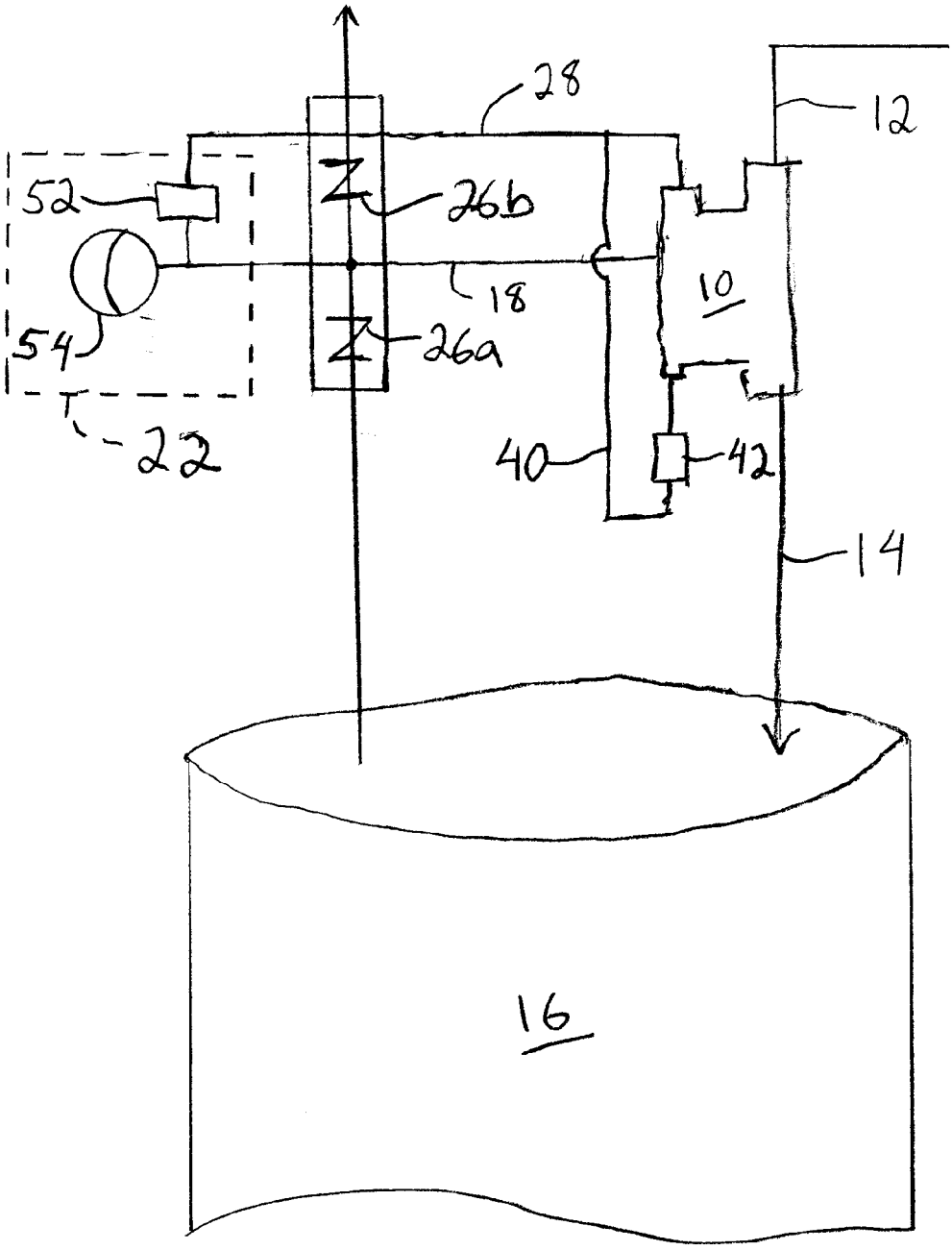

In another embodiment shown in FIG. 3, the delay device 22 includes a labyrinth 52 and a buffer or bladder device 54. The labyrinth 52 ensures less flow and the bladder device 54 ensures that the supply pressure sensor line 18 does not fill too quickly. This provides the proper amount of pressure between the check valves 26*a*, 26*b*.

Accordingly, the fluid supply shut off valve system of the present invention provides a delay to allow water pressure to equalize between the input and output side of the shut off valve, thereby preventing false triggers. The fluid supply shut off valve system of the present invention also accounts for the thermal expansion and contraction of water.

Modifications and substitutions by one of ordinary skill in the art are considered to be within the scope of the present invention, which is not to be limited except by the following claims.

The invention claimed is:

1. A fluid supply shut off valve system for use with a device to be protected, said fluid supply shut off valve system comprising:

a fluid monitoring device including a shut off valve, a main input, a main output, and a supply pressure sensor line, wherein said shut off valve is in a normally closed position and opens to supply fluid from said main input to said main output in response to a drop in pressure sensed by said supply pressure sensor line on an output side of said device to be protected, wherein said fluid monitoring device monitors a pressure differential between said main input and said main output and causes said shut off valve to remain closed when said pressure differential reaches a predetermined amount; and a delay device coupled to said supply pressure sensor line, wherein said delay device delays the response to an increase in pressure at said output side of said device to be protected.

2. The fluid supply shut off valve system of claim 1 wherein said delay device includes at least one of a dripper, a labyrinth, and a water hammer.

3. The fluid supply shut off valve system of claim 1 further comprising a thermal expansion/contraction device, for allowing contracting fluid to be drawn back into said device to be protected.

4. The fluid supply shut off valve system of claim 1 wherein said delay device includes at least one of a dripper and a labyrinth, and wherein said delay device also includes a water hammer.

5. The fluid supply shut off valve system of claim 4 further comprising a thermal compensation expansion/contraction device, for allowing contracting fluid to be drawn back into said device to be protected.

6. The fluid supply shut off valve system of claim 1 wherein said fluid monitoring device further includes a supply line for connecting to said output side of said device to be protected, wherein said delay device is coupled to said supply line.

7. A fluid supply shut off valve system for use with a device to be protected, said fluid supply shut off valve system comprising:

a fluid monitoring device including a shut off valve, a main input, a main output, and a supply pressure sensor line, wherein said shut off valve is in a normally closed position and opens to supply fluid from said main input to said main output in response to a drop in pressure sensed by said supply pressure sensor line on an output side of said device to be protected, wherein said fluid monitoring device monitors a pressure differential between said main input and said main output and causes said shut off valve to remain closed when said pressure differential reaches a predetermined amount; and a thermal expansion/contraction device coupled to said fluid monitoring device, for allowing contracting fluid to be drawn back into said device to be protected.

8. The fluid supply shut off valve system of claim 7 wherein said fluid monitoring device further includes a supply line for connecting to said output side of said device to be protected.

9. The fluid supply shut off valve system of claim 8 further comprising a delay device coupled to said supply pressure sensor line, wherein said delay device delays the response to an increase in pressure at said output side of said device to be protected.

10. The fluid supply shut off valve system of claim 8 further comprising a thermal expansion line coupled between an output side of said fluid monitoring device and said supply line, wherein said thermal expansion/contraction device is provided in said thermal expansion line.

11. The fluid supply shut off valve system of claim 10 wherein said fluid monitoring device includes a thermal expansion shut off mechanism to prevent fluid from being drawn back into the device being protected when said fluid monitoring device is closed.

12. The fluid supply shut off valve system of claim 7 wherein said thermal expansion/contraction device is a labyrinth.

13. A fluid supply shut off valve system for use with a device to be protected, said fluid supply shut off valve system comprising:

a fluid monitoring device including a shut off valve, a main input, a main output, and a supply pressure sensor line, wherein said shut off valve is in a normally closed position and opens to supply fluid from said main input to said main output in response to a drop in pressure sensed by said supply pressure sensor line on an output side of said device to be protected, wherein said fluid monitoring device monitors a pressure differential between said main input and said main output and causes said shut off valve to remain closed when said pressure differential reaches a predetermined amount;

a delay device coupled to said supply pressure sensor line, wherein said delay device delays the response to an increase in pressure at said output side of said device to be protected; and a thermal expansion/contraction device coupled to said fluid monitoring device, for allowing contracting fluid to be drawn back into said device to be protected.

14. The fluid supply shut off valve system of claim 13 further comprising a check valve coupled to said output side of said device to be protected on each side of said delay device.

15. The fluid supply shut off valve system of claim 13 wherein said fluid monitoring device further includes a supply line for connecting to said output side of said device to be protected, and wherein said delay device is between said supply line and said supply pressure sensor line.

16. The fluid supply shut off valve system of claim 15 further comprising a thermal expansion line coupled between an output side of said fluid monitoring device and said supply line, wherein said thermal expansion/contraction device is provided in said thermal expansion line.

17. The fluid supply shut off valve system of claim 16 wherein said fluid monitoring device includes a thermal expansion shut off mechanism to prevent fluid from being drawn back into the device being protected when said fluid monitoring device is closed.

18. The fluid supply shut off valve of claim 13 wherein said delay device includes a labyrinth and a bladder device.

* * * * *